US010876282B1

(12) United States Patent
Mou et al.

(10) Patent No.: US 10,876,282 B1
(45) Date of Patent: Dec. 29, 2020

(54) FABRICATED LIMITING-REINFORCED STEEL-WOOD FROSTED SLEEVE COMPOSITE JOINT

(71) Applicant: QINGDAO UNIVERSITY OF TECHNOLOGY, Qingdao (CN)

(72) Inventors: Ben Mou, Qingdao (CN); Peng Feng, Qingdao (CN); Xu Liu, Qingdao (CN); Jijun Miao, Qingdao (CN)

(73) Assignee: QINGDAO UNIVERSITY OF TECHNOLOGY, Qingdao (CN)

( * ) Notice: Subject to any disclaimer, the term of this patent is extended or adjusted under 35 U.S.C. 154(b) by 0 days.

(21) Appl. No.: 17/026,291

(22) Filed: Sep. 20, 2020

(30) Foreign Application Priority Data

Sep. 21, 2019 (CN) ..... 2019 1 0895543

(51) Int. Cl.
*E04B 1/26* (2006.01)
*E04B 1/30* (2006.01)
*E04C 3/36* (2006.01)

(52) U.S. Cl.
CPC ..... *E04B 1/2608* (2013.01); *E04B 1/30* (2013.01); *E04C 3/36* (2013.01); *E04B 2001/2644* (2013.01); *E04B 2001/2652* (2013.01)

(58) Field of Classification Search
CPC .. E04B 1/2608; E04B 1/30; E04B 2001/2644; E04B 2001/2652; E04C 3/36
See application file for complete search history.

(56) References Cited

U.S. PATENT DOCUMENTS 3,938,294 A * 2/1976 Gaburri ..... E04B 1/30 52/742.14
7,941,985 B2 * 5/2011 Simmons ..... E04B 1/24 52/655.1
8,359,797 B2 * 1/2013 Lee ..... E04B 1/04 52/259

(Continued)

FOREIGN PATENT DOCUMENTS

CN 103556711 A 2/2014
CN 103953120 A 7/2014

(Continued)

*Primary Examiner* — Rodney Mintz
(74) *Attorney, Agent, or Firm* — Bayramoglu Law Offices LLC

(57) ABSTRACT

A fabricated limiting-reinforced steel-wood frosted sleeve composite joint includes a square central column, X-shaped wood beams and a beam-column connecting assembly, wherein the beam-column connecting assembly is fixedly disposed around an outer side of the square central column, and the X-shaped wood beams are located on an outer side of the beam-column connecting assembly and are fixedly connected with the beam-column connecting assembly. The square central column comprises a frosted wood column, a frosted steel sleeve, a frosted wood sleeve shell, a Fiber Reinforced Polymer (FRP) layer and central column frosted steel covers, wherein a first central hole penetrating through the frosted wood column is formed in the center of the frosted wood column in a lengthwise direction, a prestressed steel strand penetrates through the first central hole, the frosted steel sleeve is of a hollow tetrahedral structure and is fixedly disposed around an outer side of the frosted wood column.

8 Claims, 11 Drawing Sheets

(56) References Cited

U.S. PATENT DOCUMENTS 8,474,204 B2 * 7/2013 Pan ..... E04B 1/165 52/259
8,549,805 B2 * 10/2013 Kim ..... E04C 5/0645 52/260
8,621,803 B2 * 1/2014 Efros ..... E04G 23/0237 52/391
10,006,212 B2 * 6/2018 Chen ..... E04B 1/34321
10,024,047 B2 * 7/2018 Zavitz ..... E04B 1/215
10,094,101 B1 * 10/2018 Jazzar ..... E04B 5/32
10,167,623 B2 * 1/2019 Mou ..... E04B 1/2403
10,260,224 B1 * 4/2019 Jazzar ..... E04G 11/48
10,378,197 B2 * 8/2019 Kurosawa ..... E04B 5/29
10,557,264 B2 * 2/2020 Zavitz ..... E04B 5/17
10,619,342 B2 * 4/2020 Zavitz ..... E04B 1/21
10,633,851 B2 * 4/2020 Mou ..... E04B 1/21
10,822,789 B1 * 11/2020 Mou ..... E04B 1/2608
2002/0166304 A1 * 11/2002 Pareti ..... E04C 3/36 52/655.2
2008/0295443 A1 * 12/2008 Simmons ..... E04B 1/24 52/655.1
2011/0131908 A1 * 6/2011 Lee ..... E04B 5/023 52/283
2012/0304584 A1 * 12/2012 Pan ..... E04B 1/165 52/655.1
2013/0111839 A1 * 5/2013 Efros ..... E04G 23/0237 52/391
2014/0245693 A1 * 9/2014 Efros ..... E04B 1/26 52/741.4
2015/0191907 A1 * 7/2015 Efros ..... E04B 5/12 52/745.05
2016/0230386 A1 * 8/2016 Zavitz ..... E04B 5/17
2017/0051495 A1 * 2/2017 Zavitz ..... E04B 1/4121
2017/0145708 A1 * 5/2017 Chen ..... E04B 1/34384
2017/0175376 A1 * 6/2017 Calderon Uriszar-Aldaca ..... E04B 1/215
2017/0314254 A1 * 11/2017 Houghton ..... E04B 1/2403
2018/0127966 A1 * 5/2018 Kurosawa ..... E04B 1/30
2018/0187407 A1 * 7/2018 Mou ..... E04B 1/2403
2018/0291612 A1 * 10/2018 Zavitz ..... E04C 5/0645
2019/0010695 A1 * 1/2019 Zavitz ..... E04C 5/0645
2019/0249409 A1 * 8/2019 Boyd ..... E04B 1/1912
2019/0376273 A1 * 12/2019 Mou ..... E04B 1/21
2020/0149288 A1 * 5/2020 Griechen ..... E04B 1/08
2020/0190799 A1 * 6/2020 Wong ..... E04C 1/24

FOREIGN PATENT DOCUMENTS

CN 104032832 A 9/2014
CN 106368315 A 2/2017
JP 2004211424 A 7/2004

* cited by examiner

FABRICATED LIMITING-REINFORCED STEEL-WOOD FROSTED SLEEVE COMPOSITE JOINT

CROSS REFERENCE TO THE RELATED APPLICATIONS

This application is based upon and claims priority to Chinese Patent Application No. 201910895543.7, filed on Sep. 21, 2019, the entire contents of which are incorporated herein by reference.

TECHNICAL FIELD

The invention relates to connecting joints for buildings, in particular to a fabricated limiting-reinforced steel-wood frosted sleeve composite joint.

BACKGROUND

In the era of industrial and intelligent buildings, the construction requirements for buildings are not limited to safety and reliability anymore, and people have put forward higher requirements for the economical efficiency, environment and period of construction. Compared with traditional reinforced concrete buildings and steel-structured buildings which have the drawbacks of high labor cost, poor environmental friendliness and long construction period, fabricated structures can solve such problems and possess unique superiorities in the building field.

Steel, as one of the materials commonly used for constructional engineering, is featured by high strength, low weight and good ductility, and mass-produced steel products are low in manufacturing cost, uniform in quality and high in qualification rate. However, steel connection of traditional building structures is typically realized by field welding, which leads to complicated manual welding procedures, high labor costs, long construction periods, inevitable defects, and complicated and time-consuming detection means. Wood, as one of the building materials with the longest usage history, has the features of extensive material resources, easy processing and environmental friendliness. However, traditional wood structures are simple and poor in anti-seismic performance and cannot be used as material materials of multi-storied and high-rise buildings. In terms of researches in recent years, Fiber Reinforced Polymer (FRP) characterized by low weight, high strength, corrosion resistance and fatigue resistance can be applied to components to improve the stress of the components and structures.

SUMMARY

The objective of the invention is to solves the above-mentioned problems of the prior art by providing a fabricated limiting-reinforced steel-wood frosted sleeve composite joint, which integrates the advantages of steel, wood and FRP and fulfills productization, fabrication and standardization of composite joints. All components can be prefabricated in factory and then transported to the field to be connected, so that defects caused by manual welding are overcome, the labor cost is effectively reduced, the efficiency is improved, and the construction period is shortened.

The technical solution of the invention is as follows: A fabricated limiting-reinforced steel-wood frosted sleeve composite joint comprises a square central column, X-shaped wood beams and a beam-column connecting assembly, wherein the beam-column connecting assembly is fixedly disposed around an outer side of the square central column, and the X-shaped wood beams are located on an outer side of the beam-column connecting assembly and are fixedly connected with the beam-column connecting assembly;

The square central column comprises a frosted wood column, a frosted steel sleeve, a frosted wood sleeve shell, a FRP layer and central column frosted steel covers, wherein a central hole I penetrating through the frosted wood column is formed in the center of the frosted wood column in a lengthwise direction, a prestressed steel strand penetrates through the central hole I, the frosted steel sleeve is of a hollow tetrahedral structure and is fixedly disposed around an outer side of the frosted wood column, the size of upper and lower ends of the frosted wood column is smaller than that of the middle of the frosted wood column, and closed annular slots are formed between the upper and lower ends of the frosted steel sleeve and two ends of the frosted wood column;

The frosted wood sleeve shell is fixedly disposed on an outer side of the frosted steel sleeve, rectangular holes I penetrating through the frosted wood sleeve shell are formed in four right-angle positions of the frosted wood sleeve shell, steel bars penetrate through the rectangular holes I, and a plurality of threaded holes I are formed in the middle of the frosted wood sleeve shell;

The central column frosted steel covers are respectively fixed to the top and the bottom of the frosted wood sleeve shell and each comprise a square cover plate and an insert plate fixed on one side of the cover plate, the insert plates are fixedly inserted into the annular slots formed between the frosted steel sleeve and the frosted wood column, a central hole II allowing the prestressed steel strand to penetrate through is formed in the center of each cover plate, rectangular holes II allowing the steel bars to penetrate through are formed at four right-angle positions of each cover plate, and an outer side of the frosted wood sleeve shell and outer sides of the two central column frosted steel covers at the top and the bottom are wrapped with the FRP layer;

Each X-shaped wood beam has an X-shaped longitudinal section and has an upper surface and a lower surface being horizontal planes, wherein the upper surface and the lower surface are connected through concaved arc side faces on two sides, and a plurality of threaded holes II are formed in the upper surface, the lower surface and the two arc side faces;

The beam-column connecting assembly comprises an upper outer ring plate, a lower outer ring plate, and four T-shaped beams; each T-shaped beam comprises a square steel plate and two arc patches fixed on an outer side of the square steel plate, wherein the two arc patches are arranged symmetrically, the curvature of the arc patches is equal to that of the arc side faces in the middle of one X-shaped wood beam, the middle of the X-shaped wood beam is inserted between the two arc patches, the arc patches are fixedly connected with the arc side faces of the X-shaped wood beam, and the square steel plate is fixedly connected with the frosted wood sleeve shell, the outer ring plates are fixed at the tops and bottoms of the X-shaped wood beams respectively, rectangular inner holes are formed in the outer ring plates, the square steel plates of the four T-shaped beams are disposed in the rectangular inner holes of the outer ring plates, a square hole is defined by the four square steel plates, and the square central column is disposed in the square hole.

The cross-section of the square central column is square, the cross-section of the frosted wood column, the cross-section of the frosted steel sleeve, the cross-section of the frosted wood sleeve shell and the cross-section of a square pipe column are square, correspondingly, and the central column frosted steel covers are square.

The prestressed steel strand sequentially penetrates through the central hole II of the central column frosted steel cover at the top, the central hole I of the frosted wood column and the central hole II of the central column frosted steel cover at the bottom, and is anchored at upper and lower ends of outer sides of the central column frosted steel covers; and the steel bars sequentially penetrate through the rectangular holes II of the central column frost steel cover at the top, the rectangular holes of the frosted wood sleeve shell and the rectangular holes II of the central column frosted steel cover at the bottom, and are anchored at the upper and lower ends of the outer sides of the central column frosted steel covers.

Each outer ring plate is formed by four outer ring blocks which are connected together, connecting plates are symmetrically disposed at two ends of each outer ring block, every two adjacent outer ring blocks are fixedly connected, the four outer ring blocks are connected end-to-end to from a rectangular inner hole, the outer contour of each of the ring plates is shaped like a regular octagon having steel plate extending out from four spaced side edges thereof, and the width of the steel plates is equal to that of the upper and lower surfaces of the X-shaped wood beams.

The frosted wood sleeve shell comprises four corner columns and four wood plates, wherein adjacent side edges of the wood plates are fixedly connected through the corner columns, and the adjacent side edges of the four wood plates are connected end-to-end to form a hollow cavity around the outer side of the frosted steel sleeve, the corner columns are each of a right-angle structure, wedge-shaped insert heads are disposed on two right-angle sides of each corner column in a lengthwise direction, notches are formed in two side faces of each wood plate in the lengthwise direction, correspondingly, the insert heads are disposed in the notches, and the four adjacent wood plates are connected into a whole through the corner columns.

An inner surface of the frosted steel sleeve is in interference fit with an outer surface of the frosted wood column, an inner surface of the frosted wood sleeve shell is in interference fit with an outer surface of the frosted steel sleeve, and the insert plates are in interference fit with the annular slots.

A plurality of threaded holes are formed in each of the outer ring plates, and the upper and lower outer ring plates are fixedly connected with the X-shaped wood beams through bolts.

The arc patches are fixedly connected with the arc side faces of the X-shaped wood beams through bolts, and the square steel plates are fixedly connected with the frosted wood sleeve shell through bolts.

The invention has the following beneficial effects:

(1) Steel, wood and FRP are combined, so that the invention integrates the characteristics of reliability, firmness, usage of local materials, easy processing and good stress performance of steel structures, wood structures and FRP;

(2) In design, the square central column, as the main stressed component, adopts a full-length design to extend through the whole joint in the height direction, thus improving the overall rigidity; and the prestressed steel strand and the steel bars improve the lateral force resistance of the joint and effectively reduce the displacement of the joint in an earthquake;

(3) The frosted surfaces of the components of the joint and the interference fit between these components can bright the friction energy dissipation effect of the joint into full play;

(4) By adoption of the fabricated structure, components are prefabricated in factory and are mechanically connected stably and reliably, so that defects caused by manual welding are avoided, and the joint has the superiorities of environmental friendliness, little pollution and low manufacturing costs, and has broad application and development prospects.

In the figures: 1, square central column; 2, X-shaped wood beam; 3, beam-column connecting assembly; 4, frosted wood column; 5, frosted steel sleeve; 6, frosted wood sleeve shell; 7, FRP layer; 8, central column frosted steel cover; 9, prestressed steel strand; 10, steel bar; 11, outer ring block; 12, T-shaped beam; 13, cover plate; 14, insert plate; 15, square steel plate; 16, arc patch; 17, outer ring plate; 18, central hole I; 10, slot; 20, rectangular hole I; 21, threaded hole I; 22, central hole II; 23, rectangular hole II; 24, threaded hole II; 25, corner column; 26, insert head; 27, wood plate; 28, notch.

DETAILED DESCRIPTION OF THE EMBODIMENTS

To gain a better understanding of the purposes, features and advantages of the invention, the embodiments of the invention are expounded below in conjunction with the accompanying drawings.

Specific details are illustrated in the following description for the purpose of a comprehensive understanding of the invention. However, the invention can also be implemented in other ways different from those described herein. Those skilled in the art can obtain similar transformations without departing from the concept of the invention. Therefore, the invention is not limited to the specific embodiments disclosed below.

Embodiment 1

Figure 1:
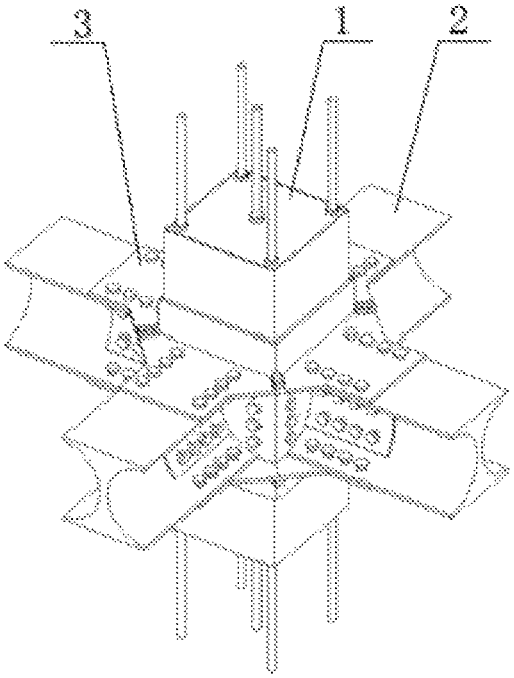
FIG. 1 is a structural diagram of the invention.
Figure 2A:
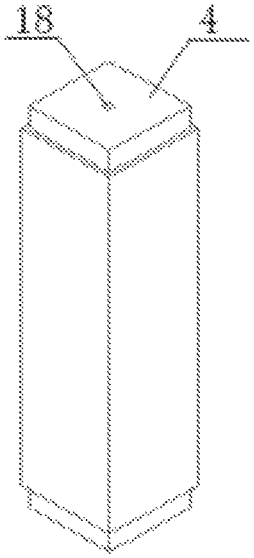
FIG. 2A is a structural diagram of a frosted wood column.
Figure 2B:
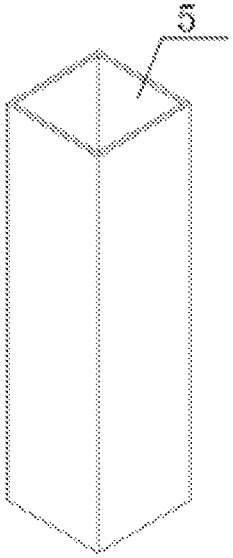
FIG. 2B is a structural diagram of a frosted steel sleeve.
Figure 2C:
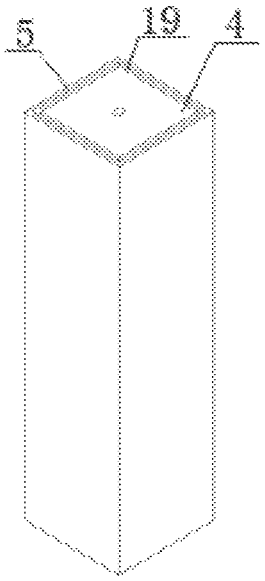
FIG. 2C is a structural diagram obtained after the frosted wood column and the frosted steel sleeve are combined.
Figure 3A:
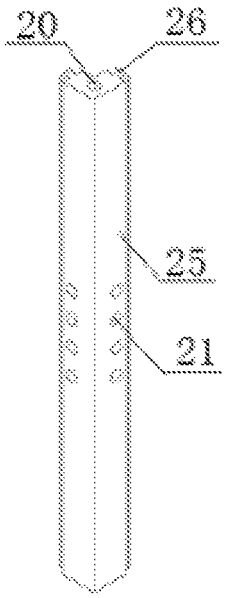
FIG. 3A is a structural diagram of a corner column in Embodiment 2.
Figure 3B:
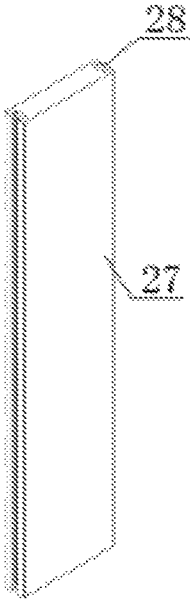
FIG. 3B is a structural diagram of a wood plate in Embodiment 2.
Figure 3C:
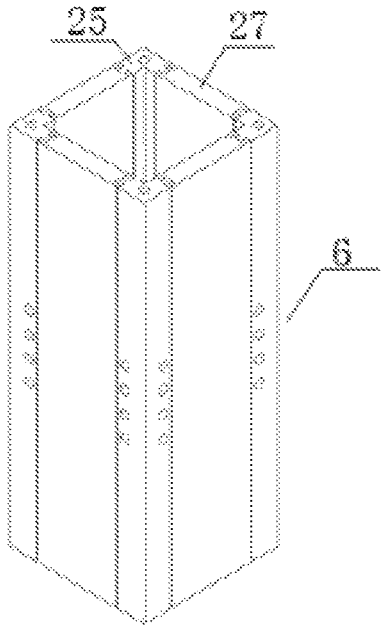
FIG. 3C is a structural diagram of a frosted wood sleeve shell in Embodiment 2.
Figure 3D:
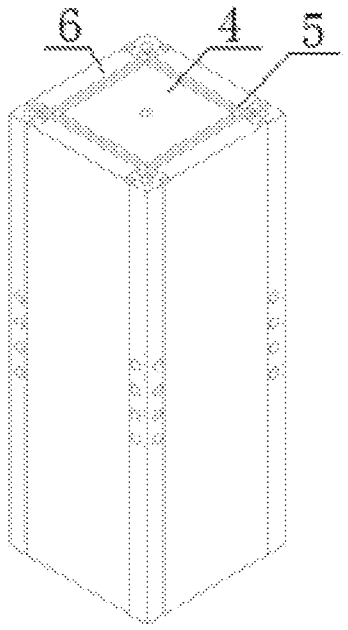
FIG. 3D is a structural diagram obtained after the frosted wood sleeve shell, the frosted wood column and the frosted steel sleeve are combined.

As shown in FIG. 1, the invention provides a fabricated limiting-reinforced steel-wood frosted sleeve composite joint which comprises a square central column 1, X-shaped wood beams 2 and a beam-column connecting assembly 3, wherein the beam-column connecting assembly 3 is fixedly disposed around an outer side of the square central column 1, and the X-shaped wood beams 2 are located on an outer side of the beam-column connecting assembly 3 and are fixedly connected with the beam-column connecting assembly 3, so that the square central column 1 and the X-shaped wood beams 2 are connected through the beam-column connecting assembly 3.

As shown in FIG. 2 to FIG. 6, the square central column 1 comprises a frosted wood column 4, a frosted steel sleeve 5, a frosted wood sleeve shell 6, a FRP layer 7 and central column frosted steel covers 8. As shown in FIG. 2A to FIG. 2C, the frosted wood column 4 is of a cuboid structure, a central hole 118 penetrating through the frosted wood column 4 is formed in the center of the frosted wood column 4 in a lengthwise direction, and a prestressed steel strand 9 penetrates through the central hole I 18, so that the integrity of the joint is improved. The frosted steel sleeve 5 is of a hollow tetrahedral structure, is disposed around the outer side of the frosted wood column 4 and is as long as the frosted wood column 4. An inner surface of the frosted steel sleeve 5 is in interference fit with an outer surface of the frosted wood column 4, so that the frosted steel sleeve 5 and the frosted wood column 4 are fixedly connected; and under the friction effect of the frosted outer surface of the frosted wood column 4, the frosted steel sleeve 5 and the frosted wood column 4 are better fixed together. Because the size of the upper and lower ends of the frosted wood column 4 is smaller than that of the middle of the frosted wood column 4, closed annular slots 19 are formed between the upper and lower ends of the frosted steel sleeve 5 and two ends of the frosted wood column 4. The full-length frosted steel sleeve can withstand the bending moment and shear force in the structure and can enhance the strength of the structure.

As shown in FIG. 3A, FIG. 3B, FIG. 3C and FIG. 3D, the frosted wood sleeve shell 6 comprises four corner columns 25 and four wood plates 27, wherein adjacent side edges of the wood plates 27 are fixedly connected through the corner columns 25, and the adjacent side edges of the four wood plates 27 are connected end-to-end to form a hollow cavity of a cuboid structure. The corner columns 25 are each of a right-angled structure, wedge-shaped insert heads 26 are disposed on right-angle side faces in a lengthwise direction of the corner columns 25, notches 28 are respectively formed in two side faces in a lengthwise direction of each wood plate 27, correspondingly, and the insert heads 26 are disposed in the notches 28, so that the four adjacent wood plates 27 are connected into a whole through the corner columns 25. The frosted wood sleeve shell 6 is of a hollow cuboid structure, is disposed around an outer side of the frosted steel sleeve 5, and is as long as the frosted steel sleeve 5 and the frosted wood column 4, and an inner surface of the frosted wood sleeve shell 6 is in interface fit with the outer surface of the frosted steel sleeve 5, so that the frosted wood sleeve shell 6 and the frosted steel sleeve 5 are fixedly connected. Rectangular holes I 20 are formed in four right-angle positions of each corner column 25 and penetrate through the corner column 25, and steel bars 10 penetrate through the rectangular holes I 20. The frosted wood sleeve shell 6 is equivalent to a protection layer that can reduce corrosion of the frosted steel sleeve and prolong the service time of the joint, and can also serve as a component that can withstand the pressure and bending moment. Multiple threaded holes I 21 are formed in the middle of each corner column 25, so that the corner columns 25 can be fixedly connected with the beam-column connecting assembly through bolts.

Figure 4A:
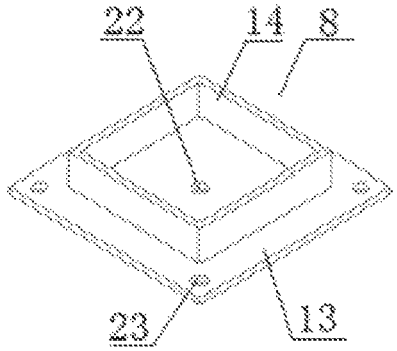
FIG. 4A is a structural diagram of one central column frosted steel cover.
Figure 4B:
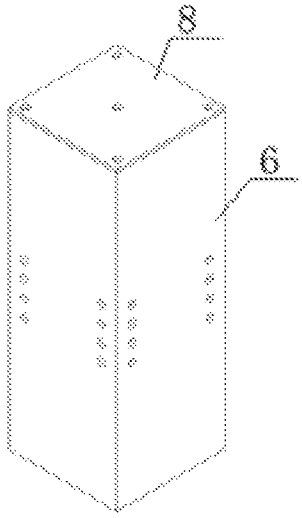
FIG. 4B is a structural diagram obtained after the central column frosted steel covers, the frosted wood sleeve shell, the frosted wood column and the frosted steel sleeve are combined.
Figure 5:
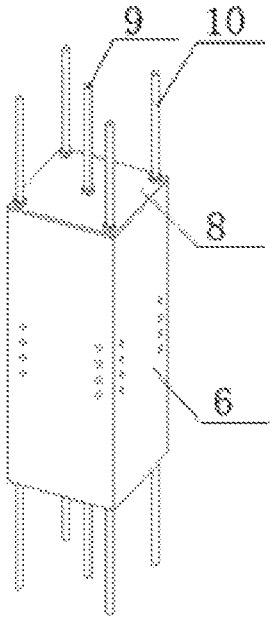
FIG. 5 is a structural diagram obtained after steel bars and a prestressed steel strand are inserted into the structure in FIG. 4B.

As shown in FIG. 4A and FIG. 4B, the central column frosted steel covers 8 are fixed on outer sides of the tops and bottoms of the frost wood sleeve shell 6, the frosted steel sleeve 5 and the frosted wood column 4. Each central column frosted steel cover 8 comprises a square cover plate 13 and an insert plate 14 fixed on one side of the cover plate, the size of the cover plates 13 is equal to that of the end of the frosted wood sleeve shell 6, and the insert plates 14 are inserted into the slots 19 and are in interference fit with the slots 19, so that the insert plates 14 are fixedly connected with the frosted steel sleeve 5 and the frosted wood column 4. A central hole II 22 is formed in the center of each cover plate 13, and the prestressed steel strand 9 penetrates through the central hole II 22; and rectangular holes II 23 are formed in four right-angle positions of each cover plate 13, and the steel bars 10 penetrate through the rectangular holes II 23. As shown in FIG. 5, the prestressed steel strand 9 sequentially penetrates through the central hole II of the central column frosted steel cover at the top, the central hole I of the frosted wood column 4 and the central hole II of the central column frosted steel cover at the bottom, and is anchored at upper and lower ends of outer sides of the central column frosted steel covers. The steel bars 10 sequentially penetrate through the rectangular holes II of the central column frosted steel cover at the top, the rectangular holes I 20 of the frosted wood sleeve shell 6 and the rectangular holes II of the central column frosted steel cover at the bottom, and are anchored at the upper and lower ends of the outer sides of the central column frosted steel covers.

Figure 6A:
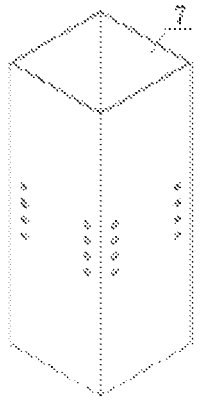
FIG. 6A is a structural diagram of a FRP layer.
Figure 6B:
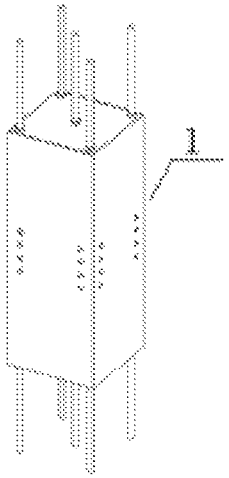
FIG. 6B is a structural diagram obtained after the FRP layer is combined with the structure in FIG. 5.

As shown in FIG. 6A and FIG. 6B, an outer side of the frosted wood sleeve shell 6 and outer sides of the central column frosted steel covers 8 at the top and the bottom are wrapped with the FRP layer 7 to reduce the corrosion of air to steel and wood; and the FRP layer 7 is bonded on the frosted wood sleeve shell with environmentally-friendly glue, so that the bonding effect of the components is improved by frosted materials. Through holes may be reserved in positions, corresponding to the threaded holes I of the frosted wood sleeve shell 6, of the FRP layer 7 to allow the bolts to penetrate through. The FRP layer 7 protects the frosted wood sleeve shell against damp and improves the corrosion resistance.

Figure 8:
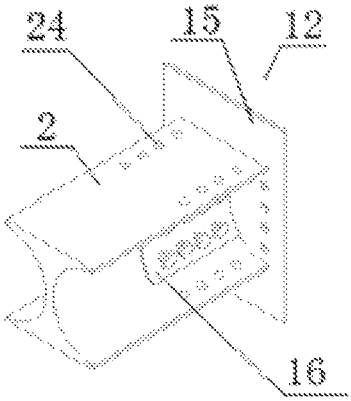
FIG. 8 is a structural diagram obtained after a T-shaped beam and an X-shaped wood beam are fixedly connected.

The fabricated limiting-reinforced steel-wood frosted sleeve composite joint comprises four X-shaped wood beams 2. As shown in FIG. 8, the X-shaped wood beams 2 each have an X-shaped longitudinal section and each have an upper surface and a lower surfaces being horizontal planes, wherein the upper surface and the lower surface are connected through concaved arc side faces on two sides, and multiple threaded holes II 24 are formed in the upper surface, the lower surface and the two arc side faces, so that the X-shaped wood beams 2 can be fixedly connected with the beam-column connecting assembly 3 through bolts.

Figure 7:
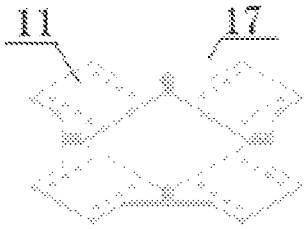
FIG. 7 is a structural diagram of an outer ring plate.
Figure 9:
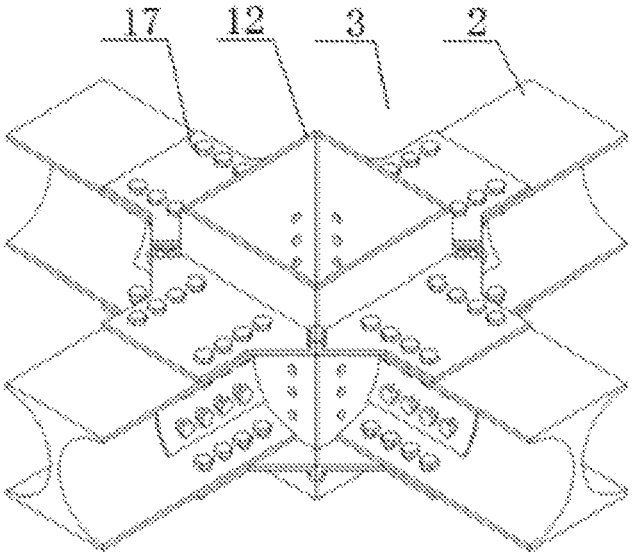
FIG. 9 is a structural diagram of X-shaped wood beams and beam-column connecting assembly.

As shown in FIG. 7 to FIG. 9, the beam-column connecting assembly 3 comprises upper and lower outer ring plates 17 and four T-shaped beams 12. Each T-shaped beam 12 comprises a square steel plate 15 and two arc patches 16 fixed on an outer side of the square steel plate, wherein the two arc patches 16 are arranged symmetrically, and the curvature of the arc patches is equal to that of the arc side faces in the middle of each X-shaped wood beam 2; a gap is reserved between the two arc patches to allow the middle of one X-shaped wood beam 2 to be inserted between the two arc patches; the arc patches 16 are formed with a plurality of threaded holes and are fixedly connected with the arc side faces of one X-shaped wood beam 2 through bolts, so that the T-shaped beam 12 and the X-shaped wood beam 2 are fixedly connected. The square steel plates of the T-shaped beams 12 are each formed with a plurality of threaded holes and are fixedly connected with the frosted wood sleeve shell 6 through bolts, so that the square central column 1 and the beam-column connecting assembly 3 are fixedly connected.

The outer ring plates 17 are fixed to the tops and bottoms of the X-shaped wood beams 2. Each outer ring plate 17 is formed by four outer ring blocks 11 which are connected together, wherein connecting plates are symmetrically arranged at two ends of each outer ring block 11, the connecting plate of every two adjacent outer ring blocks 11 are fixedly connected through bolts, and the four outer ring blocks are connected end-to-end to form a rectangular inner hole. The square steel plates of the four T-shaped beams are disposed in the rectangular inner holes of the outer ring plates 17, a square hole is defined by the four square steel plates 15 and is identical in shape with the outer surface of the square central column 1, and the square central column is disposed in the square hole. The outer contour of each outer ring plate 17 is shaped like a regular octagon having steel plates stretching out from four spaced side edges thereof, and the width of the steel plates is equal to that of the upper and lower surfaces of the X-shaped wood beams. A plurality of threaded holes are formed in each outer ring plate 17, and the upper and lower outer ring plates 17 are fixedly connected with the X-shaped wood beams 2 through bolts, so that the X-shaped wood beams 2 and the beam-column connecting assembly 3 are fixedly connected, and the connecting strength between components can be guaranteed without welding. The outer ring plates are merely used to connect the T-shaped beams in the structure and can improve the integrality and overall rigidity of the structure on the whole.

In this embodiment, the cross-section of the central square column 1 is square, the cross-section of the frosted wood column 4, the cross-section of the frosted steel sleeve 5, the cross-section of the frosted wood sleeve shell 6 and the cross-section of a square pipe column are all square, and the central column frosted steel covers 8 are also square.

The assembly process of the invention is as follows:

First of all, the square central column 1 is assembled as follows: the frosted steel sleeve 5 is fixedly disposed around the outer side of the frosted wood column 4, the frosted wood sleeve shell 6 is fixedly disposed around the outer side of the frosted steel sleeve 5, and the central column frosted steel covers 8 are fixedly inserted into the slots 19 located at the top and the bottom between the frosted wood column 4 and the frosted steel sleeve 5, so that the outer contour of the square central column (1) is approximately formed.

Second, the prestressed steel strand 9 is made to sequentially penetrate through the central hole II of the central column frosted steel cover at the top, the central hole I 18 of the frosted wood column 4 and the central hole II of the central column frosted steel cover at the bottom, and is then anchored on the outer sides of the two central column frosted steel covers; the steel bars 10 are made to sequentially penetrate through the rectangular holes II of the central column frosted steel cover at the top, the rectangular holes I 20 of the frosted wood sleeve shell 6 and the rectangular holes II of the central column frosted steel cover at the bottom, and are then anchored on the outer sides of the two central column frosted steel covers. The FRP layer 7 is bonded to the outer side of the frosted wood sleeve shell 6 and the outer sides of the central column frosted steel covers 8, so that the whole square central column 1 is formed.

Third, every four outer ring blocks 11 are connected end-to-end to be assembled into one complete outer ring plate 17, wherein the outer contour of the outer ring plate 17 is shaped like a regular octagon having steel plates stretching out from four spaced side edges thereof, the inner contour of the outer ring plate 17 is rectangular, and the width of the steel plates is equal that of the upper and lower sides of the X-shaped wood beams 2.

Fourth, the arc side faces in the middle of the X-shaped wood beams 2 are fixedly connected with the arc patches 16 of the T-shaped beams 12 through bolts, the upper and lower surfaces of the X-shaped wood beams 2 are fixedly connected with the outer ring plates 17 through bolts, the beam-column connecting assembly 3 is disposed around the outer side of the square central column 1 and is moved to a specified position, and the square plates 15 of the T-shaped beams 12 are fixedly connected with the square central column 1 through bolts, so that the whole fabricated limiting-reinforced steel-wood frosted sleeve composite joint is formed.

Embodiment 2

Figure 10A:
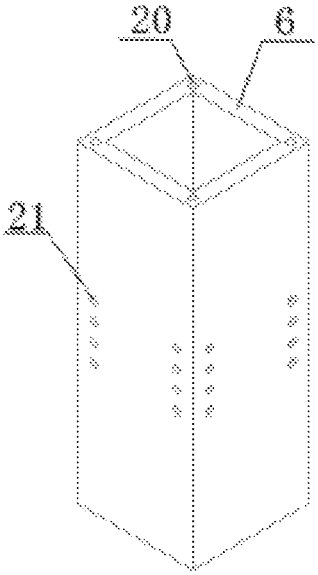
FIG. 10A is a structural diagram of the frosted wood sleeve shell in Embodiment 2.
Figure 10B:
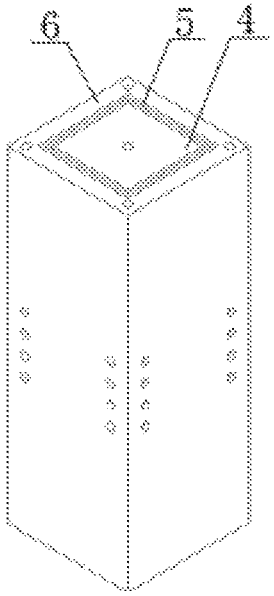
FIG. 10B is a structural diagram obtained after the frosted wood sleeve shell, the frosted wood column and the frosted steel sleeve in Embodiment 2 are combined.

Different from Embodiment 1, the frosted wood sleeve shell 6 in this embodiment is of an integral structure, as shown in FIG. 10A to FIG. 10B.

This embodiment is identical with Embodiment 1 in other aspects.

The fabricated limiting-reinforced steel-wood frosted sleeve composite joint provided by the invention is introduced in detail above. In this specification, the principle and implementation of the invention are illustrated with specific embodiments, and the above embodiments are merely for the purpose of a better understanding of the method and core concept thereof. It should be noted that those commonly skilled in the art can make various improvements and modifications to the invention without departing from the principle of the invention, and all these improvements and modifications should also fall within the protection scope of the invention. Those skilled in the art can implement or use the invention by referring to the above description of the embodiments disclosed. Different modifications to these embodiments will be obvious for those skilled in the art, and the general principle defined in the specification can be implemented in other embodiments without departing from the spirit or scope of the invention. Therefore, the invention will not be limited to the embodiments disclosed in this specification, and has the broadest scope in accordance with the principle and novel features disclosed in this specification.

What is claimed is:

1. A fabricated limiting-reinforced steel-wood frosted sleeve composite joint, comprising a square central column, X-shaped wood beams and a beam-column connecting assembly, wherein the beam-column connecting assembly is fixedly disposed around an outer side of the square central column, and the X-shaped wood beams are located on an outer side of the beam-column connecting assembly and the X-shaped wood beams are fixedly connected with the beam-column connecting assembly;

the square central column comprises a frosted wood column, a frosted steel sleeve, a frosted wood sleeve shell, a Fiber Reinforced Polymer (FRP) layer and central column frosted steel covers, wherein a first central hole penetrating through the frosted wood column is formed in a center of the frosted wood column in a lengthwise direction, a prestressed steel strand penetrates through the first central hole, the frosted steel sleeve is of a hollow tetrahedral structure and the frosted steel sleeve is fixedly disposed around an outer side of the frosted wood column, a size of upper and lower ends of the frosted wood column is smaller than a size of a middle of the frosted wood column, and closed annular slots are formed between the upper and lower ends of the frosted steel sleeve and two ends of the frosted wood column;

the frosted wood sleeve shell is fixedly disposed on an outer side of the frosted steel sleeve, first rectangular holes penetrating through the frosted wood sleeve shell are formed in four right-angle positions of the frosted wood sleeve shell, steel bars penetrate through the first rectangular holes, and a plurality of first threaded holes are formed in a middle of the frosted wood sleeve shell;

the central column frosted steel covers are respectively fixed to a top and a bottom of the frosted wood sleeve shell and each of the central column frosted steel covers comprise a square cover plate and an insert plate fixed on one side of the square cover plate, wherein the insert plates are fixedly inserted into the closed annular slots formed between the frosted steel sleeve and the frosted wood column, a second central hole allowing the prestressed steel strand to penetrate through is formed in a center of each square cover plate, and second rectangular holes allowing the steel bars to penetrate through are formed at four right-angle positions of the each square cover plate;

an outer side of the frosted wood sleeve shell and outer sides of the central column frosted steel covers at the top and the bottom of the frosted wood sleeve shell are wrapped with the FRP layer;

each of the X-shaped wood beams has an X-shaped longitudinal section and has an upper surface and a lower surface being horizontal planes, wherein the upper surface and the lower surface are connected through concaved arc side faces on two sides of the X-shaped wood beam, and a plurality of second threaded holes are formed in the upper surface, the lower surface and the concaved arc side faces;

the beam-column connecting assembly comprises an upper outer ring plate, a lower outer ring plate, and four T-shaped beams, wherein each of the four T-shaped beams comprises a square steel plate and two arc patches fixed on an outer side of the square steel plate, wherein the two arc patches are arranged symmetrically, a curvature of the two arc patches is equal to a curvature of the concaved arc side faces in a middle of the X-shaped wood beam, the middle of the X-shaped wood beam is inserted between the two arc patches, the two arc patches are fixedly connected with the concaved arc side faces of the X-shaped wood beam, and the square steel plate is fixedly connected with the frosted wood sleeve shell;

the upper outer ring plate and the lower outer ring plate are fixed at tops and bottoms of the X-shaped wood beams respectively, rectangular inner holes are formed in the upper outer ring plate and the lower outer ring plate, four square steel plates of the four T-shaped beams are disposed in the rectangular inner holes of the upper outer ring plate and the lower outer ring plate, a square hole is defined by the four square steel plates, and the square central column is disposed in the square hole.

2. The fabricated limiting-reinforced steel-wood frosted sleeve composite joint according to claim 1, wherein a cross-section of the square central column is square, a cross-section of the frosted wood column, a cross-section of the frosted steel sleeve, a cross-section of the frosted wood sleeve shell and a cross-section of a square pipe column are square, correspondingly, and the central column frosted steel covers are square.

3. The fabricated limiting-reinforced steel-wood frosted sleeve composite joint according to claim 1, wherein the prestressed steel strand sequentially penetrates through the second central hole of the each of the central column frosted steel covers at the top, the first central hole of the frosted wood column and the second central hole of the each of the central column frosted steel covers at the bottom, and is anchored at upper and lower ends of outer sides of the central column frosted steel covers, the steel bars sequentially penetrate through the second rectangular holes of the each of the central column frost steel covers at the top, and the first rectangular holes of the frosted wood sleeve shell and the second rectangular holes of the each of the central column frosted steel covers at the bottom, and are anchored at the upper and lower ends of the outer sides of the central column frosted steel covers.

4. The fabricated limiting-reinforced steel-wood frosted sleeve composite joint according to claim 1, wherein each of the upper outer ring plate and the lower outer ring plate is formed by four outer ring blocks, wherein the four outer blocks are connected together, connecting plates are symmetrically disposed at two ends of each of the four outer ring block, every two adjacent outer ring blocks are fixedly connected, the four outer ring blocks are connected end-to-end to from a rectangular inner hole, an outer contour of the each of the upper outer ring plate and the lower outer ring plate is shaped to be a regular octagon having steel plate extending out from four spaced side edges of the upper outer ring plate and the lower outer ring plate, and a width of the steel plates is equal to a width of the upper and lower surfaces of the X-shaped wood beams.

5. The fabricated limiting-reinforced steel-wood frosted sleeve composite joint according to claim 1, wherein the frosted wood sleeve shell comprises four corner columns and four wood plates, wherein adjacent side edges of the four wood plates are fixedly connected through the four corner columns, the adjacent side edges of the four wood plates are connected end-to-end to form a hollow cavity around the outer side of the frosted steel sleeve, each of the four corner columns is of a right-angle structure, wedge-shaped insert heads are disposed on two right-angle sides of each of the four corner columns in the lengthwise direction, notches are formed in two side faces of each of the four wood plates in the lengthwise direction, correspondingly, the wedge-shaped insert heads are disposed in the notches, and the four wood plates are connected into a whole through the corner columns and the four wood plates are adjacent.

6. The fabricated limiting-reinforced steel-wood frosted sleeve composite joint according to claim 1, wherein an inner surface of the frosted steel sleeve is in an interference fit with an outer surface of the frosted wood column, an inner surface of the frosted wood sleeve shell is in an interference fit with an outer surface of the frosted steel sleeve, and the insert plates are in an interference fit with the closed annular slots.

7. The fabricated limiting-reinforced steel-wood frosted sleeve composite joint according to claim 1, wherein a plurality of threaded holes are formed in each of the outer ring plates, and the upper and lower outer ring plates are fixedly connected with the X-shaped wood beams through bolts.

8. The fabricated limiting-reinforced steel-wood frosted sleeve composite joint according to claim 1, wherein the two arc patches are fixedly connected with the concaved arc side faces of the X-shaped wood beams through first bolts, and the four square steel plates are fixedly connected with the frosted wood sleeve shell through second bolts.

* * * * *